United States Patent [19]

Sattrup et al.

[11] Patent Number: 4,812,219

[45] Date of Patent: Mar. 14, 1989

[54] METHOD OF PRODUCING A SURFACE SLEEVE FOR A PLATE CYLINDER FOR PRINTING PURPOSES

[75] Inventors: Jens E. Sattrup, Byaekpark 37, DK-3520 Farum; Ole Brøndsted, Søborg, both of Denmark

[73] Assignee: Jens Erik Sattrup, Farum, Denmark

[21] Appl. No.: 93,745

[22] PCT Filed: Dec. 22, 1986

[86] PCT No.: PCT/DK86/00136

§ 371 Date: Aug. 19, 1987

§ 102(e) Date: Aug. 19, 1987

[87] PCT Pub. No.: WO87/03843

PCT Pub. Date: Jul. 2, 1987

[51] Int. Cl.[4] ..... B41F 13/10; C25D 7/04

[52] U.S. Cl. ..... 101/375; 204/25

[58] Field of Search ..... 204/25, 40; 101/375

[56] References Cited

U.S. PATENT DOCUMENTS

| | | | |
|---|---|---|---|
| 4,276,148 | 6/1981 | Otthofer, Jr. | 204/281 |
| 4,503,769 | 3/1985 | Andersen | 101/153 |

FOREIGN PATENT DOCUMENTS

| | | |
|---|---|---|
| 127277 | 10/1973 | Denmark . |
| 143592 | 9/1981 | Denmark . |
| 221584 | 12/1987 | Denmark . |
| 9360 | 2/1980 | European Pat. Off. . |
| 54165 | 6/1982 | European Pat. Off. . |
| 92285 | 10/1983 | European Pat. Off. . |
| 3231490 | 10/1983 | Fed. Rep. of Germany . |
| 7807649 | 2/1979 | Netherlands . |
| 388249 | 2/1933 | United Kingdom . |
| 388250 | 2/1933 | United Kingdom . |
| 2051681 | 1/1981 | United Kingdom . |
| 387170 | 2/1983 | United Kingdom . |

*Primary Examiner*—T. M. Tufariello

*Attorney, Agent, or Firm*—Merchant, Gould, Smith, Edell, Welter & Schmidt

[57] ABSTRACT

A surface sleeve for a rotogravure cylinder or an offset cylinder is produced by mounting a basic sleeve (20) on a supporting mandrel (10). Both the outer peripheral surface of the mandrel and the inner and outer surfaces of the basic sleeve are circularly cylindrical. On the nickel cylinder (20), a thin layer (21) of copper or nickel is deposited electrolytically, and on top of this layer an outer copper layer (22), preferably high-gloss copper, is deposited. In the case of rotogravure, this outer copper layer has a thickness which equals or slightly exceeds the desired maximum well depth of the printing pattern later to be made in the outer surface of the surface sleeve. In the case of offset printing, the outer copper layer is coated with a chrome layer in which the printing pattern is etched. After etching or engraving of a printing pattern in the outer surface of the sleeve, and after a possible chrome-plating of the etched or engraved surface, the free end parts of the surface sleeve are cut off, as the thickness of the metal layers there has become increased during the electrolytic deposits.

28 Claims, 1 Drawing Sheet

METHOD OF PRODUCING A SURFACE SLEEVE FOR A PLATE CYLINDER FOR PRINTING PURPOSES

Figure 1:
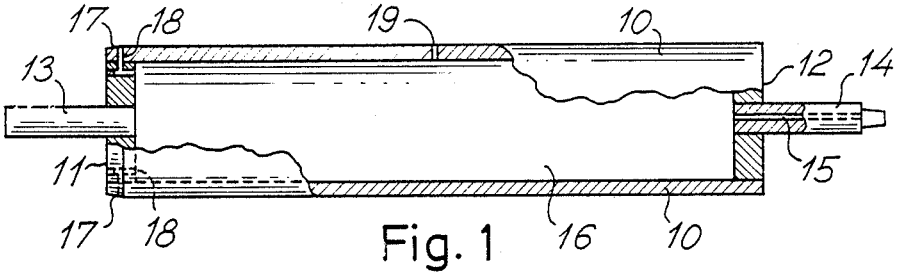

The present invention relates to a method of producing a surface sleeve for a plate cylinder, said method comprising arranging around a supporting mandrel a basic sleeve which is made of an electrically conductive material such as metal, preferably nickel, and has an inner surface which is complementary to the outer surface of the mandrel, electrolytically depositing an inner metal layer on the outer surface of the basic sleeve, and providing on the said inner layer an outer copper layer with a smooth circularly cylindrical surface.

The term "cyanide copper" as used in the present specification and claims means copper which has been deposited in a cyanide-containing bath, the term "high-gloss copper" means copper which has been deposited in a bath containing gloss promoting or gloss generating additives, and the term "chloride nickel" means nickel which has been deposited in an acidic nickel chloride bath.

Published European patent application No. 92285 describes a method of the above type in which a nickel layer is deposited on a mandrel having a slightly conical outer surface. The basic sleeve thus formed is loosened and removed from the said first mandrel and slipped over another conical mandrel which is provided with an axial bore for compressed air with air outlets on the peripheral surface of the mandrel. During the process of slipping the formed basic sleeve of nickel over the said second mandrel, the thin-walled sleeve is exposed to a certain tangential stretching produced by means of the compressed air. While the basic sleeve is arranged on the mandrel in a stretched condition, its outer surface is immersed in a cyanide containing bath, and a thin layer of cyanide copper is deposited electrolytically on the outer conical surface of the basic sleeve. The mandrel with the sleeve arranged thereon is then transferred to another bath in which high-gloss copper in a layer, which is substantially thicker than the cyanide copper layer, is deposited on top of the cyanide copper layer. As the outer peripheral surface of the basic sleeve with the two coats of copper layers is substantially conical, and as the thickness of the electrolytically deposited copper layers is inevitable slightly larger at the ends of the sleeve than along the intermediate part, the mandrel with the sleeve is now arranged in a lathe, and the last deposited copper layer is turned so that a completely circularly cylindrical surface is achieved. Finally, yet a copper layer of so-called hard copper is deposited electrolytically and polished, whereupon the desired gravure pattern is produced photographically or by engraving in a manner known per se on the said polished outer surface of the outermost copper layer.

In this known method the intermediate one of the deposited copper layers has to be sufficiently thick to compensate for the conical shape of the surface at the said turning. As the thickness of the copper layer thus has to exceed the difference between the largest and the smallest diameter of the conical shape, sleeves of a certain length may involve a relatively large thickness of the said intermediate copper layer. The result is that the depositing of the said intermediate metal layer, which is high-gloss copper in the known method, takes diproportionately long, and also the necessary turning operation contributes to increasing the time of production and thus the cost of production for the surface sleeve.

The present invention provides a method of the above type, in which it is possible to produce surface sleeves for plate cylinders in a manner which takes substantially less time and is thus cheaper than the above known method.

The method according to the invention is characterized in using a mandrel and a basic sleeve having outer peripheral surfaces which have a circularly cylindrical shape, and cutting off the end parts of the sleeve after the electrolytic depositing of the outer copper layer thereon. It has been found that by starting from a basic sleeve, the peripheral outer surface of which has a circularly cylindrical shape, it is possible, without having to perform a turning operation, to obtain a perfectly circularly cylindrical surface for the outer copper layer apart from the end parts of the sleeve where the electrolytic depositing will inevitably deposit thicker metal layers than along the intermediate part of the sleeve. However, as these end parts are cut off in the method according to the invention, it is merely necessary to use a basic sleeve having a length exceeding the length of the finished surface sleeve.

As surface sleeves produced by the method according to the invention have a circularly cylindrical inner surface, one plate cylinder may have several surface sleeves mounted on it with the same or different orientation.

As a turning operation is avoided in the method according to the invention, it is not necessary to deposit the relatively thick intermediate copper layer. This means that the time required for depositing the metal layers on the basic sleeve using the method according to the invention is many times shorter than the time required using the known method.

The inner metal layer deposited on the basic sleeve may be of any metal which may adhere suitably to the basic sleeve, and on which the outer copper layer may adhere. In the method according to the invention an inner copper layer, which is then preferably cyanide copper, may be deposited on the outer surface of the basic sleeve. Alternatively an inner nickel layer, which is then preferably chloride nickel, may be deposited on the outer surface of the basic sleeve.

The method according to the invention may be used for producing a surface sleeve for a rotogravure cylinder. In this case the outer copper layer is deposited in a thickness which all over exceeds the desired depth of the wells or depressions in the printing pattern later to be made in the surface of the outer copper layer.

However, the method according to the invention may also be used for producing a surface sleeve for an offset printing cylinder. In this case the outer copper layer may possibly be given a smaller thickness, but it is coated with a layer of chrome, preferably so-called matt hard-chrome, in which the printing pattern is later made in a manner known per se by etching of the chrome layer after sensitizing, copying and retouching. By replacing the normally used offset printing plates which are fixed onto an offset cylinder by a surface sleeve produced by the method according to the invention, it is possible to produce endless print patterns or print patterns in which paper waste is avoided.

The circularly cylindrical basic sleeve may be produced electrolytically in a conventional manner, for example by using "METTENHEIMER Schnellvernicklungsanlage", made by G.W. Mettenheimer & Co.

K.G., Kirchnerstrasse 13, 6 Frankfurt/Main, Federal Republic of Germany. Instead may be used prefabricated basic sleeves of nickel of a type which is generally known in connection with flexography, and which is marketed by Stork Screens B.V., Postbus 67, 5830 AB Boxmeer, Holland.

The basic sleeve may, in principle, have any thickness, but normally a wall thickness of 0.1–0.2 mm, preferably 0.125 mm is chosen, as the sleeve then obtains a suitable elasticity for being expanded and mounted on a mandrel or a plate cylinder. This elasticity further has the effect that when the sleeve is stored without being mounted on a mandrel or a cylinder, it is more difficult to impart a lasting deformation to it, if it is exposed to incidental pressures or shocks.

In principle, the basic sleeve may be arranged on the mandrel in any suitable manner as long as the basic sleeve is kept completely expanded and is arranged fixedly on the cylinder. In a preferred embodiment a mandrel is used having an outer diameter which slightly exceeds the inner diameter of the basic sleeve, and the basic sleeve is expanded by means of a pressure fluid while being mounted on the mandrel. When the supply of pressure fluid, which is preferably compressed air, ceases, the sleeve will fit tightly around the mandrel in consequence of its elasticity.

A circularly cylindrical basic sleeve as the one used in the method according to the invention has the advantage compared to the conical sleeve used in known method, that it has a uniform wall thickness which may be selected so as to be most suitable. When a conical basic sleeve is used having a suitable elasticity at the end where the wall thickness is smallest, the elasticity might become inconveniently small at the end where the wall thickness is largest. If the elasticity is suitable at the end where the wall thickness is largest, there is a risk of the sleeve breaking during expansion at the end where the wall thickness is smallest.

The inner metal layer which is deposited on the basic sleeve electrolytically, is preferably a cyanide copper layer or a chloride nickel layer, and in the method according to the invention the said inner metal layer may be deposited by removing a first deposited layer by means of reversing the current, before the final metal layer is deposited. It has been found that this operation prepares the surface of the basic sleeve in such a manner that the final inner metal layer adheres better to the sleeve surface than would otherwise have been the case. As the deposited inner metal layer only serves as a link between the surface of the basic sleeve and the outer copper layer in which the printing pattern is made, in the case of rotogravure, the inner metal layer may be made relatively thin and is normally about 2 μm. The outer copper layer deposited on the inner metal layer necessarily, in the case of rotogravure, has to have a thickness at least equal to the largest well depth, and the thickness of the outer copper layer may then suitably be about 100–110 μm.

The electrolytic depositing of the metal layers on the basic sleeve may be performed using any of the known methods. During the depositing, the mandrel with the basic sleeve arranged thereon is preferably only partially immersed in the galvanic bath, the mandrel at the same time being rotated at a uniform speed. As mentioned above, the mandrel used in the method according to the invention has to have a circularly cylindrical outer surface, and the mandrel may thus be in the form of a plate cylinder.

The cutting off of the end sleeve performed according to the method of the invention, is performed after the outer copper layer and any further metal layers have been deposited on the basic sleeve. In the case of a sleeve for rotogravure, a desired printing pattern is engraved or etched in the polished surface of the outer copper layer, and then advantageously, the outer surface of the surface sleeve is chrome-plated in a known manner. In the case of offset printing, the printing pattern is etched into a chrome layer deposited on the outer copper layer, as mentioned above. The cutting off of the end parts of the sleeve is then advantageously performed only after a finished printing pattern has been made in the sleeve surface.

Figure 2:
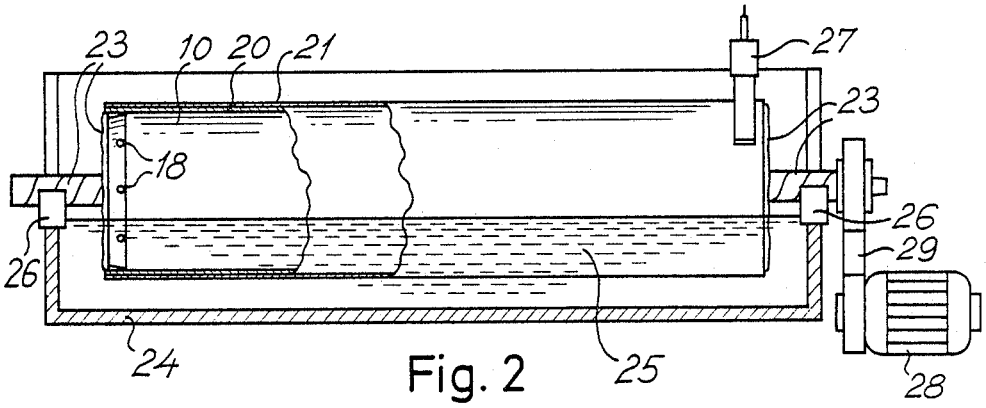
Figure 3:
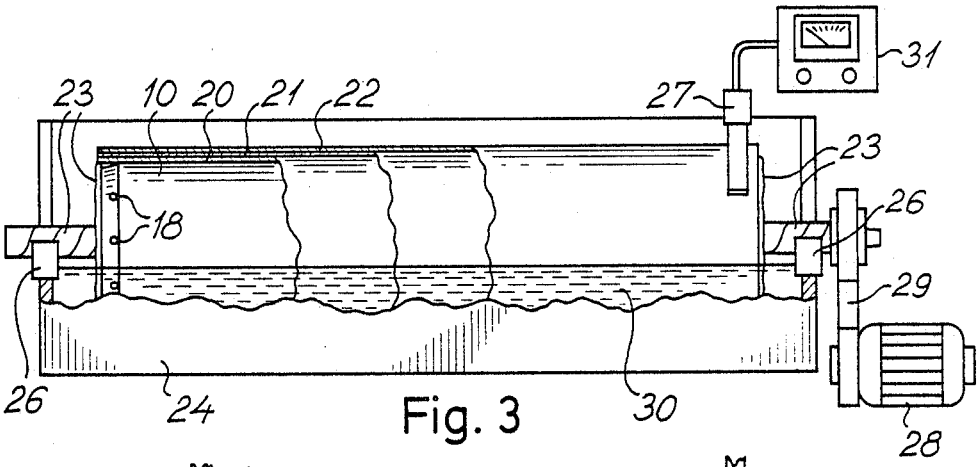
Figure 4:
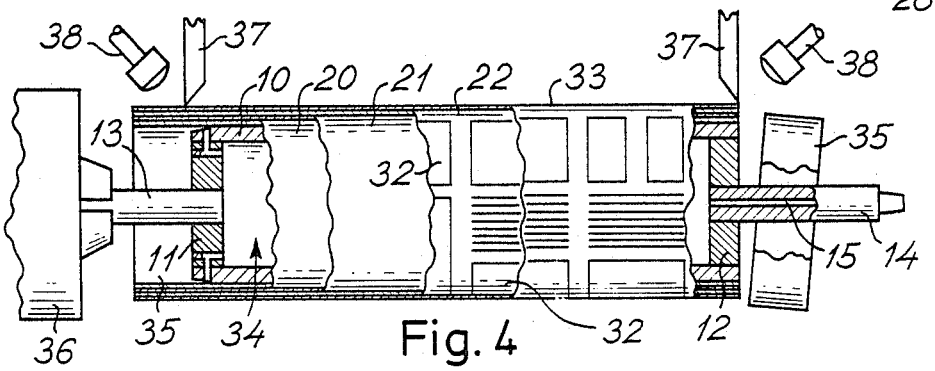

The invention will now be further described with reference to the drawing in which FIG. 1 is a longitudinal partially sectional side view of a plate cylinder used as a mandrel, FIG. 2 is a partially sectional side view of the mandrel or plate cylinder with a basic sleeve mounted thereon and arranged in a galvanic bath for depositing of an inner metal layer, FIG. 3 is a partially sectional side view of the same mandrel or plate cylinder arranged in another galvanic bath for depositing of an outer copper layer on top of the inner metal layer, and FIG. 4 shows the finished surface sleeve mounted on another, shorter mandrel or plate cylinder fixed in a lathe for cutting off of the end parts of the surface sleeve.

FIG. 1 shows a mandrel or plate cylinder with a cylindrical casing 10 which is closed at the ends by means of end walls 11 and 12. Centrally in the end walls 11 and 12 are mounted shaft studs 13 and 14 which project from the end walls, and one of these shaft studs 14 has an axial air passage 15 which leads to an air chamber 16 defined inside the cylinder or mandrel. At the end of the plate cylinder or the mandrel opposite to the air passage 15, the outer surface of the cylindrical casing 10 has a bevelled area 17, and immediately inside of this area, bores 18 which are connected to the air chamber 16 open out into the surface of the mandrel. Further there are one or more bores 19 in the central area of the casing 10.

When a surface sleeve for rotogravure or offset printing is to be produced by means of a cylinder or mandrel as shown in FIG. 1 and described above, using the method according to the invention, it may be done as described in the below examples:

EXAMPLE 1

As a basic cylinder 20 is used a nickel sleeve of the type marketed by Stork Screens B.V., Boxmeer, Holland. These sleeves which are supplied in lengths of 180 cm and have a wall thickness of 0.125 mm, have a completely accurately circularly cylindrical surface. The casing 10 for the mandrel or cylinder shown in FIG. 1 has a cylindrical outer surface, the diameter of which is 1/10 mm larger than the internal diameter for the basic sleeve 20. The basic sleeve 20 is now mounted on the cylinder shown in FIG. 1, one end of the sleeve being slipped over the bevelled area 17 at the same time as compressed air is supplied to the air chamber 16 through the shaft stud 14 formed as an air supply connecting piece. The supplied compressed air causes the nickel sleeve 20 to be stretched in a tangential direction whereby the sleeve is expanded to such a degree that it is easily slipped over the cylindrical casing 10. When the basic sleeve 20 is arranged on the casing 10, the supply of compressed air is stopped, and the nickel sleeve is now tightly fitted on the mandrel or cylinder. The basic sleeve 20 which is arranged on the mandrel has to have a length which exceeds the desired length of the finished surface sleeve. The basic sleeve 20 may suitably be approximately 140 mm longer than the desired finished surface sleeve.

When the basic sleeve 20 has been mounted on the mandrel or the cylinder, the still uncovered parts of the cylinder surface of the casing 10, the outer surface of the end walls 11 and 12 and the adjacent surfaces of the shaft studs 13 and 14 are covered by means of waterproof tape 23 which is wound helically. The said tape may be of the type marketed under the trade mark "Tesafilm 4105" by the firm "Tesa". The covering by means of waterproof tape 23 is made to avoid galvanic corrosion when the mandrel or cylinder, as will be described now, is immersed in a galvanic bath.

After the basic nickel sleeve has been mounted as described above, its outer surface is cleaned with a mixture of ⅓ concentration hydrochloric acid, ⅓ mineral spirits and ⅓ 99% ethyl alcohol. This liquid mixture should not dry on the surface of the sleeve, but as soon as all impurities have been removed the sleeve surface should be rinsed with a 99% ethyl alcohol and dried. Alternatively, the cleaning may be made with concentrated phosphoric acid at a temperature of 85° C. The mandrel or the cylinder with the basic sleeve 20 mounted thereon is now arranged in a container 24 containing an electrolyte 25. The shaft studs 13 and 14 of the mandrel are arranged in bearings 26 so that the mandrel may be rotated about a horizontal axis, for example by means of a motor 28 via a transmission 29. The electrolyte 25 in which about ⅓ of the mandrel or cylinder is immersed has the following composition: 48.2 g/l of copper cyanide, 40.0 g/l of sodium cyanide, 2.5 g/l of sodium hydroxide and 1.5 g/l of stabilizer.

The said stabilizer is marketed under the trade name of "cupanit" by the firm of Weiland & Cie, Bielefeld 14, Federal Republic of Germany.

The cylinder or mandrel is now rotated at a uniform speed while cyanide copper is deposited on the exposed outer cylindrical surface of the basic sleeve 20. By means of a sliding contact 27, such a voltage (1–2.5 V) is applied to the basic sleeve, which constitutes the negative electrode in the galvanic bath, that a current density of 2.0–3.5 A/dm$^2$ is obtained. After about 5 minutes a thin copper layer will have been deposited on the surface of the basic sleeve, and the current is now reversed, a current density of 3.5–5 A/dm$^2$ being produced so that the copper layer is again removed from the basic sleeve, and the shiny nickel reappears again after about 2 minutes. After about another 2 minutes the current is again reversed so that a first copper layer 21 is deposited on the outer surface of the nickel sleeve 20. After about ½ hour a cyanide copper layer 21 of a thickness of about 2 μm has been deposited on the basic sleeve 20, and the cylinder is now removed from the cyanide copper bath, rinsed and dried.

After the outer surface of the copper layer 21 has been scoured with 5% sulphuric acid, the mandrel or cylinder with the basic cylinder mounted thereon and the first copper layer 21 is arranged partially immersed in an acidic copper bath 30 (FIG. 3) of the following composition: 200–225 g/l of copper sulphate, 52–68 g/l of sulphuric acid, 30–70 ppm chlorine, 0.5–0.7% by volume of Cuflex 321, and 0.5–0.7% by volume of Cuflex 320H. The mentioned additives designated Cuflex are high-gloss generating additives marketed by the firm of Weiland & Cie.

In this bath 30, in which the mandrel or the cylinder is rotated in a manner corresponding to that in the bath 25, a layer 22 of high-gloss copper of a thickness of 100–110 μm is deposited on top of the first copper layer 21. The depositing of the said outer copper layer 22 takes about 50–80 minutes, and the current supply is governed by means of an ampere-hourmeter 31 to ensure that the correct layer thickness is obtained. When the desired outer layer 22 of copper has been deposited, the outer cylindrical surface of the said copper layer may be polished, if desired, using a polishing agent such as the one marketed under the trade mark of BRASSO®.

While the sleeve is still mounted on the mandrel or plate cylinder, a sensitizing, retouching, etching and/or engraving is performed to transfer a desired printing pattern 32 in a conventional manner in the rotogravure field.

To render possible an evaluation of the quality of the rotogravure printing pattern 32 formed in the surface sleeve, the said surface may, if desired, be polished with BRASSO®, whereby the depressions or wells of the printing pattern will appear in a transparent dark colour rendering possible an evaluation of the well depth. When the outer surface of the sleeve is then to be made ready for chrome-plating, any remains of the polishing agent are best removed by first pouring the polishing agent BRASSO® over the outer surface of the sleeve, then toluene and finally the above mentioned liquid mixture. A hard chrome-plating is now made electrolytically in a conventional manner using a current density of 18–20 A/dm$^2$ at a voltage of 8–12 volt and a temperature of 50° C.±2° C. After the hard chrome-plating in which a chrome layer 33 (FIG. 4) is formed, the waterproof tape 23 is removed. The mandrel or cylinder is then placed in a holder, and the air passage 15 is again connected to a compressed air source whereby the finished surface sleeve is stretched tangentially so that it can easily be removed from the mandrel. The now almost finished surface sleeve is arranged on another and shorter mandrel or cylinder 34 using compressed air. Then the mandrel or cylinder 34 is arranged in a chuck 36 of a lathe in which the surface sleeve end parts 35, which are not completely cylindrical, as explained above, are cut off by means of a cutting-off tool 37 so that the surface sleeve obtains the desired length. In connection with the cutting, the end edges of the surface sleeve may also, if desired, be rounded by means of tools 38 to reduce the wear, partly on the doctor blade used in connection with the rotogravure cylinder, and partly on the edges of the sleeve.

If the surface sleeve is to be used for offset printing, no etching or engraving of a printing pattern is made in the outer surface of the outer copper layer 22, but the said layer 22 is provided with a layer of hard-chrome of about 6 μm. After the chrome-plating, sensitizing, copying and retouching is carried out as is well-known in the offset printing field, and then the chrome layer is etched so that it it etched away in the places which are to receive colour. The end parts 35 of the thus produced surface sleeve are cut off in the same manner as described above.

EXAMPLE 2

A surface sleeve for rotogravure or offset printing is produced in the same manner as described in Example 1, an inner layer of chloride nickel being deposited on the outer surface of the basic sleeve 20 instead of an inner cyanide copper layer. The mandrel or the cylinder with the basic sleeve 20 mounted thereon is arranged as described in Example 1 in the container 24 in which the electrolyte 25 is a generally known acidic nickel chloride bath, for example produced as follows: 60 kg of nickel chloride is added to 60 liter of lukewarm corporation water, stirred and cooled. Then 60 liter of concentrated hydrochloric acid is added together with a suitable amount of surfactant which may be for example sulphonic detergent of the type used as dishwashing liquid.

The cylinder is rotated as previously described, and such a voltage (4–5 volt) is applied that the current density becomes 2.0–3.5 A/dm$^2$. After about 5 minutes a layer of chloride nickel has been deposited, and it is removed again by means of reversing the current - maintaining the same voltage and current density. Thus, advantageously, also a small part of the material of the basic sleeve 20 is removed from its outer surface. The current is again reversed, and in about 5 minutes a layer of chloride nickel of a thickness of about 1 μm has been deposited. The cylinder is now rinsed over the nickel bath with clean cold water and transferred into the acidic copper bath 30 before the outer surface of the cylinder dries, and then the outer copper layer 22 and a chrome layer 33 are deposited, printing patterns 32 are transferred, and the end parts 35 of the formed surface sleeve are cut off as described in Example 1.

The completely finished surface sleeve which is produced by one of the methods described in the above examples is now mounted on a rotogravure plate cylinder or an offset printing plate cylinder of the type shown in FIG. 1. This cylinder may have such a length that two or more surface sleeves may be mounted on the same cylinder, and as both the outer surface of the plate cylinder and the inner surfaces of the surface sleeves are circularly cylindrical, these surface sleeves may be oriented as desired.

We claim:

1. A method of producing a surface sleeve for a plate cylinder, said method comprising, arranging a basic sleeve made from an electrically conductive material and having inner and outer circularly cylindrical peripheral surfaces, tightly around an outer circularly cylindrical peripheral surface of a supporting mandrel, electrolytically depositing an inner metal layer on the outer peripheral surface of the basic sleeve, electrolytically depositing an outer copper layer with a smooth substantially circularly cylindrical outer surface, on said inner metal layer, and cutting off opposite outer end portions of the sleeve after depositing the outer copper layer thereon.

2. A method according to claim 1, wherein the basic sleeve is made from metal.

3. A method according to claim 2, wherein said metal is nickel.

4. A method according to claim 3, wherein the inner metal layer is a layer of copper.

5. A method according to claim 4, wherein said copper is cyanide copper.

6. A method according to claim 3, wherein the inner metal layer is a layer of chloride nickel.

7. A method according to claim 5 or 6, wherein the thickness of said inner metal layer is about 2 μm.

8. A method according to claim 3, wherein the inner metal layer is formed by depositing nickel on the outer surface of the basic sleeve.

9. A method according to claim 8, wherein said nickel is chloride nickel.

10. A method according to claim 3 wherein the outer copper layer is deposited in a thickness which all over exceeds the desired well depth in a printing pattern so as to produce a surface sleeve for a rotogravure cylinder.

11. A method according to claim 3, further comprising coating the outer copper layer with a layer of chrome in which a printing pattern is later to be made, so as to produce a surface sleeve for an offset printing cylinder.

12. A method according to claim 11, wherein said chrome is matt hard chrome.

13. A method according to claim 3, wherein the basic sleeve arranged on the mandrel is a prefabricated sleeve.

14. A method according to claim 6, wherein the basic sleeve has a wall thickness of 0.1–0.2 mm.

15. A method according to claim 3, wherein the mandrel has an outer diameter slightly exceeding the inner diameter of the basic sleeve, the basic sleeve being expanded by means of a pressure fluid while it is being arranged on the mandrel.

16. A method according to claim 3, wherein depositing of the inner metal layer includes electrolytically depositing an initial metal layer on the outer surface of the basic sleeve in an electrolytic bath by providing a certain polarity, removing said initial layer by reversing said polarity, and finally depositing said inner metal layer.

17. A method according to claim 3, wherein the outer copper layer is deposited in a thickness of about 100–110 μm.

18. A method according to claim 3, wherein said inner and outer layers are electrolytically deposited by only partially immersing the mandrel with the basic sleeve arranged thereon into an electrolytic bath and rotating the mandrel at a substantially uniform speed while immersed in said bath.

19. A method according to claim 3, wherein the mandrel is a plate cylinder.

20. A method according to claim 3, wherein a printing pattern is provided in the outer peripheral surface of the surface sleeve produced prior to cutting off said opposite outer end portions.

21. A method of producing a surface sleeve for a plate cylinder, said method comprising, arranging the basic nickel sleeve having inner and outer circularly cylindrical peripheral surfaces tightly around an outer circularly cylindrical peripheral surface of a supporting mandrel, electrolytically depositing an inner metal layer on the outer surface of the basic sleeve, electrolytically depositing an outer copper layer with a smooth substantially circularly cylindrical outer surface on said inner metal layer, providing in said outer cyanide copper layer a rotogravure printing pattern comprising wells having a depth not exceeding the thickness of said outer layer, and cutting off opposite outer end portions of the surface sleeve so produced.

22. A method according to claim 21, wherein said inner metal layer is a layer of cyanide copper.

23. A method according to claim 21, wherein said inner metal layer is a layer of chloride nickel.

24. A method of producing a surface sleeve for an offset printing cylinder, said method comprising arranging a basic nickel sleeve having inner and outer circularly cylindrical peripheral surfaces tightly around an outer circularly cylindrical peripheral surface of a supporting mandrel, electrolytically depositing an inner metal layer on the outer peripheral surface of the basic sleeve, electrolytically depositing an outer copper layer with a smooth, substantially circularly cylindrical outer surface on said inner metal layer, coating said outer copper layer with a layer of matt hard chrome, providing an offset printing pattern in the outer peripheral surface of said chrome layer, and cutting off opposite outer end portions of the surface sleeve so produced.

25. A method according to claim 24, wherein said inner metal layer is a layer of cyanide copper.

26. A method according to claim 24, wherein said inner metal layer is a layer of chloride nickel.

27. A surface sleeve for a plate cylinder and comprising a basic nickel sleeve having inner and outer circularly cylindrical peripheral surfaces, an inner metal layer electrolytically deposited on the outer peripheral surface of the basic sleeve, and an outer copper layer with a smooth, substantially circularly cylindrical outer peripheral surface electrolytically deposited on said inner metal layer and having a rotogravure printing pattern provided therein, opposite outer end portions of the surface sleeve having been cut off after deposition of said outer copper layer thereon.

28. A surface sleeve for an offset printing cylinder and comprising a basic nickel sleeve having inner and outer circularly cylindrical peripheral surfaces, an inner metal layer electrolytically deposited on the outer peripheral surface of the basic sleeve, an outer copper layer with a smooth, substantially circularly cylindrical outer peripheral surface electrolytically deposited on said inner metal layer, and a coating of a matt hard chrome layer arranged on the peripheral surface of the outer copper layer and having an offset printing pattern provided thereon, opposite outer end portions of the surface sleeve having been cut off after deposition of said outer copper layer thereon.

* * * * *

UNITED STATES PATENT AND TRADEMARK OFFICE

CERTIFICATE OF CORRECTION

PATENT NO. : 4,812,219

DATED : March 14, 1989

INVENTOR(S) : Jens E. Sattrup, et al.

It is certified that error appears in the above-identified patent and that said Letters Patent is hereby corrected as shown below:

Title page:

Insert priority data:

--[30] Foreign Application Priority Data

20 December 1985 [DK] Denmark ..... 6002/85--

In Column 1, line 67-68, "diproportionately" should be --disproportionately--;

In Column 4, line 1, after "end" insert --parts of the--.

Signed and Sealed this

Twenty-third Day of January, 1990

*Attest:*

JEFFREY M. SAMUELS

*Attesting Officer* *Acting Commissioner of Patents and Trademarks*